United States Patent [19]

Suhr

[11] Patent Number: 4,978,330

[45] Date of Patent: Dec. 18, 1990

[54] TAB FORMING TAPE DISPENSER WITH TAPE PASSING OVER CUTTER

[76] Inventor: Robert N. Suhr, 431 Chowning Pl., NW., Marietta, Ga. 30064

[21] Appl. No.: 386,782

[22] Filed: Jul. 31, 1989

[51] Int. Cl.[5] ..... B26F 3/02

[52] U.S. Cl. ..... 493/466; 225/25; 493/353

[58] Field of Search ..... 493/353, 466; 225/25, 225/21, 22, 47, 49, 77, 80

[56] References Cited

U.S. PATENT DOCUMENTS

| | | | |
|---|---|---|---|
| 2,463,445 | 3/1949 | Van Cleef | 225/25 |
| 2,526,494 | 10/1950 | McNeil | 493/466 |
| 2,663,363 | 12/1953 | Erhardt | 225/21 |
| 3,498,512 | 3/1970 | Golemon | 225/21 |
| 3,521,800 | 7/1970 | Stephens et al. | 225/21 |
| 3,895,059 | 7/1975 | Link | 225/80 |
| 4,824,427 | 4/1989 | Smillie, III | 493/466 |
| 4,944,720 | 7/1990 | Suhr | 493/466 |

*Primary Examiner*—Hien H. Phan

[57] ABSTRACT

A tape dispenser of the type where the tape passes over the cutter that has the means to allow a tab to be formed on the end portion of the tape that will not accidentally bond back to the tape roll. The means comprises three different embodiments. First, a raisable lifting member, with a horizontal projection and an opening, is located between the tape roll and cutter and below the outstretched tape. When the lifting member is raised it forms a hump in the outstretched tape. The hump is then pinched, in the opening under the projection, to form a tab. The second embodiment consists of a stationary tab-forming structure, consisting of a generally horizontal projection, located between the tape roll and cutter, but above the normal axis of the outstretched tape. To form the tab, the tape is lifted and draped over the elevated horizontal projection, and then pinched in the opening under the projection to form the tab. The third embodiment consists of a stationary tab-forming structure, consisting of a generally horizontal projection, located below the outstretched tape and between the tape roll and cutter. To form the tab, the tape is depressed onto the horizontal projection, and pinched in the opening under the projection to form the tab.

1 Claim, 3 Drawing Sheets

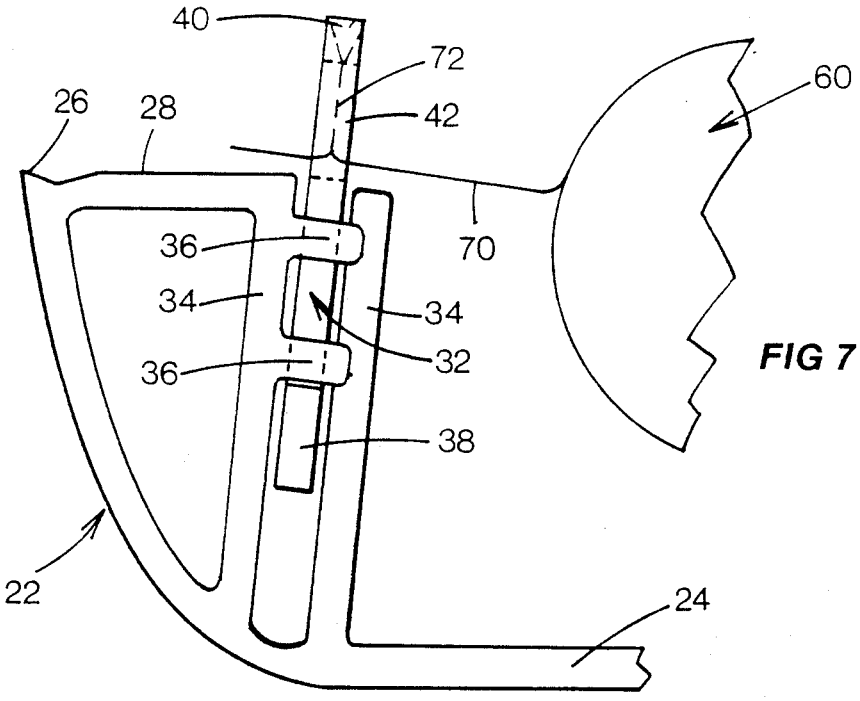
FIG 7
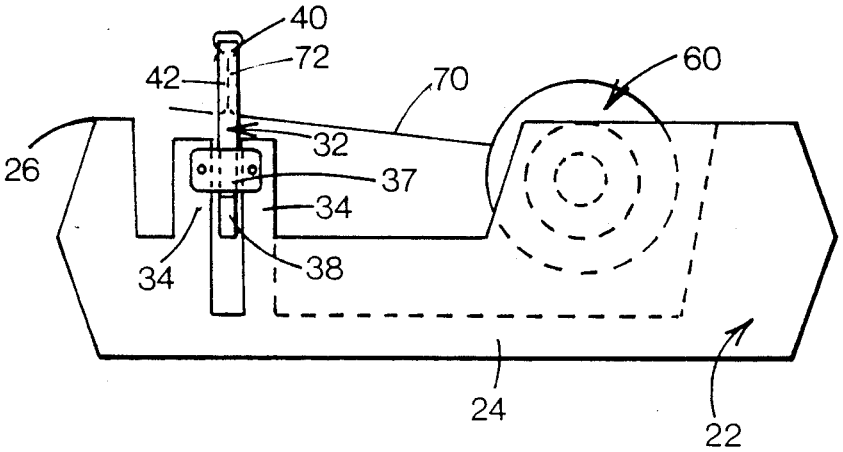
FIG 8
FIG 10
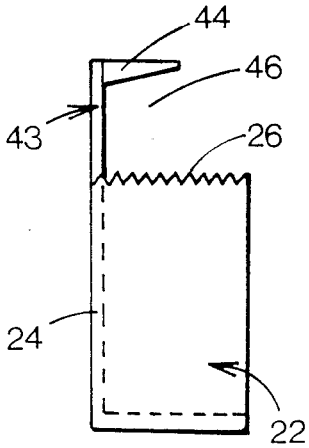
FIG 9
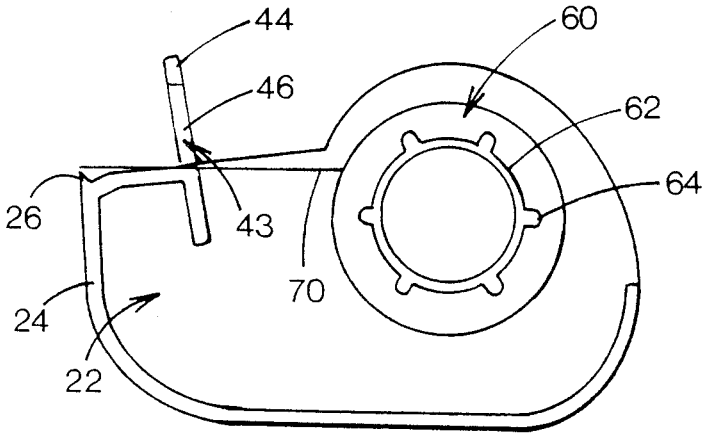

TAB FORMING TAPE DISPENSER WITH TAPE PASSING OVER CUTTER

BACKGROUND OF THE INVENTION

1. Field of the Invention

This invention relates to tape dispensers for adhesive type tape, and, more particularly, to a tape dispenser that has the means to form a tab on the end portion of the outstretched tape to prevent the tape from accidentally adhering back to the tape roll.

2. Discussion of the Prior Art:

Finding the end of adhesive type tape made of plastic or other flexible materials, that has adhered to the tape roll can be frustrating, time consuming, and sometimes impossible. The end of thin, and sometimes transparent, tape is particularly hard to locate and lift off the roll to enable the user to unwind additional tape from the roll. Frequently, the roll has to be discarded and replaced with a new roll where the end can be found and grasped.

The problem has been addressed in many ways. In U.S. Pat. No. 3,247,956 Rosen discloses an adhesive tape where a stretched elastic thread along the length of the tape contracts and puckers the cut end of the tape to enable the end to be grasped. This solution requires a special manufactured tape.

In U.S. Pat. No. 4,512,462 Dills discloses a reusable tape tab that can be repeatedly attached to the end of the outstretched tape. Such tabs can be easily misplaced and lost.

In U.S. Pat. No. 4,752,023 Lin discloses a tape dispenser with a guide roller to depress the tape forcibly against an additional adhesion tape stand to prevent dislocation of the outstretched end of the tape. Still the tape can become loose and become bonded to the roll.

Of course, the outstretched end of the tape can be lifted by a finger of one's hand in order to press the adhesive side of one area of the tape against another adhesive area in order to form a tab. However, the finger contacts the adhesive side of the tape and becomes bonded in the loop of the tape and it is extremely difficult to separate the two. Also, this method usually causes an additional length of tape to be unwound from the roll resulting in waste. Also, the tab, when formed, is loose and there is still an outstretched portion of the tape with exposed adhesive surface that can become bonded to other surfaces when the dispenser is stored.

Usually a new unused roll of tape is sold with a short paper tab adhering to the end of the tape to form a nonsticking end tab so the user can grasp the end of the tape to unwind it from the roll. This tab is available only once for the first length of tape pulled off the roll.

Tape dispensers can be divided into two types. One type has the outstretched tape extending from the roll over the cutter and the desired length of tape is severed by depressing the adhesive side against the cutter edge.

Another type, frequently used with tape to seal cartons and boxes, has the tape extending from the tape roll and under the cutter. The tape is severed by forcing the cutter edge against the non-adhesive side of the tape.

The present invention addresses the requirements of the first described dispensers where the tape passes over the cutter. These dispensers can be also further divided in two ways. First there are those where a new roll of tape is replaced in the dispenser after the first roll of tape is used up. These dispensers can be rather complicated and expensive as they will be used repeatedly.

Next, there is the dispenser that provides no means for replacing an exhausted roll of tape and is thus discarded. These discardable type dispensers must be very inexpensive. Preferably they would be of a one piece molded design. If additional parts are needed they should be as few as possible and assembly of the parts should be as simple and easy as possible.

Consequently, a need exists for a method whereby a tab can always be formed on the end of commonly used adhesive type tape, where the tab cannot accidentally stick to the roll when the dispenser is not in use, and where the tab forming method adds the very minimum additional cost to the discardable type dispenser.

SUMMARY OF THE INVENTION

Accordingly, it is the object of the present invention to provide a tape dispenser that provides the means to form a tab on the end portion of the outstretched tape that will not stick to the roll of tape.

Another object of the present invention is to provide a tape dispenser that does not need a special type tape, but can use commonly available adhesive type tape.

Another object of the present invention is to provide a tape dispenser that does not necessitate the use of some additional piece of metal or paper or other item to adhere to the end of the tape.

Another object of the present invention is to provide a tape dispenser where it is not necessary for the tape to stay bonded to an adhesion face support to prevent the loose end from sticking to the tape roll.

Another object of the present invention is to provide a tape dispenser where the non-sticking tab can be formed without the operator's fingers contacting the adhesive side of the tape.

Another object of the present invention is to provide a tape dispenser where the tab, after it is formed, can remain securely fixed to a portion of the tab-forming structure, so none of the remaining outstretched tape between the tab and the roll can accidentally adhere to other objects when the dispenser is stored amongst other packing materials.

Another object of the present invention is to provide a tape dispenser with tab-forming means which consists of only a one-piece molded part on which a roll of tape is mounted.

Another object of the present invention is to provide a tape dispenser with tab-forming means, which consists of only two parts and a roll of tape, and can be easily assembled by bending over protruding molded ears approximately 90 degrees and requiring no other assembly hardware or adhesive.

Another object of the present invention is to provide a tape dispenser which is inexpensive to manufacture, durable in structure, and efficient in operation.

These objects and others are accomplished by the tape dispenser and method of the present invention which, generally speaking, is a base which supports a cutter, a roll of adhesive type tape, and a means to form a tab. The tab-forming means can be of several different designs.

First, the tab-forming structure can consist of a lifting member and a guiding structure for the lifting member. The tape is outstretched from the roll to the cutter with the adhesive side facing down. The guiding structure, enclosing the lifting member, is located under the outstretched tape. The lifting member is enclosed in the guiding structure by means of ears extending from the edge of the guiding structure, with the ears bent over to encase the lifting member. The lifting member is raised and lowered by means of an extending foot. When raised, the foot comes in contact with a bent-over ear which limits the up-travel of the lifting member.

The upper end of the lifting member has a portion which contacts the adhesive side of the tape. There is also an opening formed in the upper end of the lifting member. This opening allows the tape to be pinched together forming the tab.

A second design of the tape forming structure consists of a stationary member that is fixed to the dispenser base and is located above the outstretched tape that extends from the roll to the cutter. The tape forming structure has a generally horizontal projection with an opening under it.

A third design of the tape forming structure consists of a stationary member that is fixed to the dispenser base but is located below the outstretched tape that extends from the roll to the cutter. This tape forming structure also has a generally horizontal projection with an opening under it.

Other objects, features, and advantages of the present invention will become apparent from the following description when taken in conjunction with the accompanying drawings wherein like characters of reference designate corresponding parts throughout the several views.

BRIEF DESCRIPTION OF THE DRAWINGS

FIG. 7 is an enlarged fragmentary side elevation, showing the lifting member in its raised position, and the formed tab.

FIG. 8 is a side elevation of a desk top type tape dispenser constructed in accordance with one embodiment of the present invention, showing the lifting member in its raised position, and the formed tab.

FIG. 9 is a side elevation of a tape dispenser being constructed in accordance with another embodiment of the present invention including an elevated stationary tab-forming structure.

FIG. 10 is a partial front elevation of FIG. 9.

DESCRIPTION OF THE PREFERRED EMBODIMENTS

Figure 1:
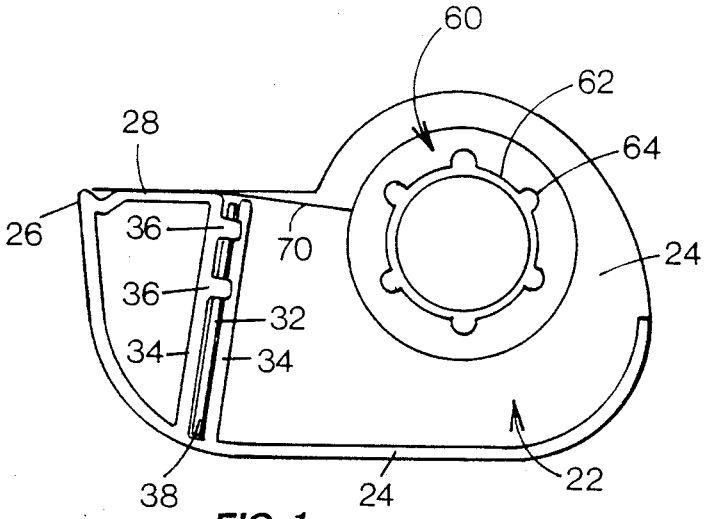
FIG. 1 is a side view of a tape dispenser being constructed in accordance with one embodiment of the present invention, including a slidable lifting member.
Figure 13:
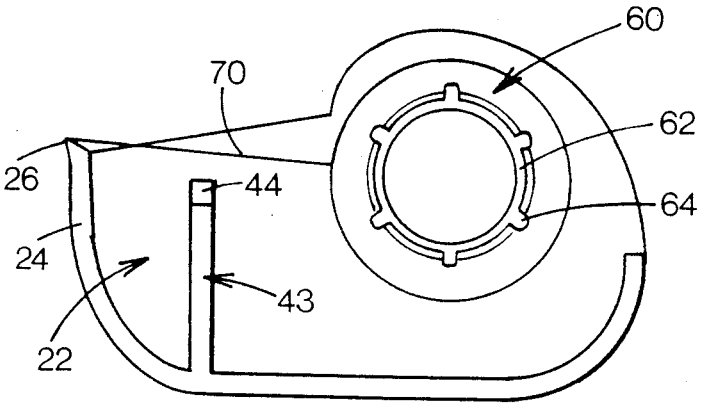
FIG. 13 is a side elevation of a tape dispenser being constructed in accordance with the third embodiment of the present invention including a stationary tab-forming structure below the outstretched tape.

Referring now to the drawings, and more particularly to FIG. 1, FIG. 9, and FIG. 13, there are shown tape dispensers generally designated 22, with three embodiments for forming tabs that will not bond to the roll of tape. The tape dispenser 22 includes a base 24, a cutter edge 26, and a roll of tape 60.

FIGS. 1–8 show a movable lifting member 32 that is raised and lowered in a guide structure 34. The lifting member 32 has tab-forming projections 40 and an opening 42.

Figure 14:
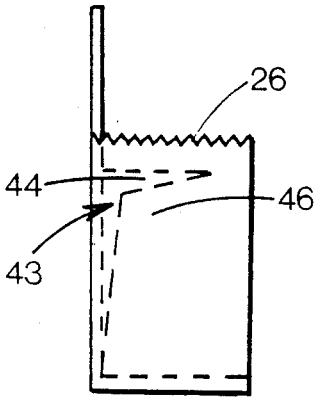
FIG. 14 is a partial front elevation of FIG. 13.
Figure 15:
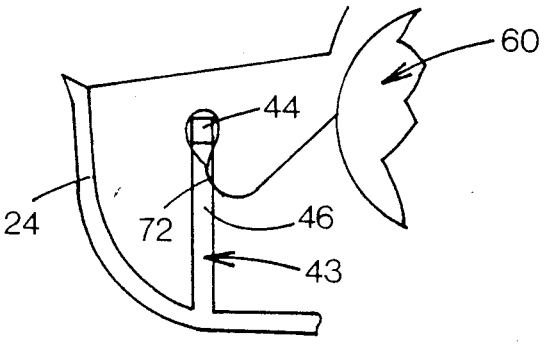
FIG. 15 is a fragmentary side view similar to FIG. 13 with the formed tab.

FIGS. 9–15 show a stationary tab-forming structure generally designated 43 with a horizontal projection 44 and an opening 46. FIGS. 9–12 show the stationary tab-forming structure 43 located above the outstretched tape 70. FIGS. 13–15 show the stationary tab-forming structure 43 located below the outstretched tape 70.

In normal usage of the tape dispenser 22, the tape 70 is pulled from the roll 60 across the cutter edge 26 and severed. Succeeding lengths of tape 70 are severed in the same manner as needed. After the operator has finished using the dispenser 22, and is ready to store it until the next use, it is desirable to form a non-sticking tab 72 on the end portion of the tape that will not accidentally adhere to the roll 60. Using one of the three described embodiments will create such a tab 72.

Figure 2:
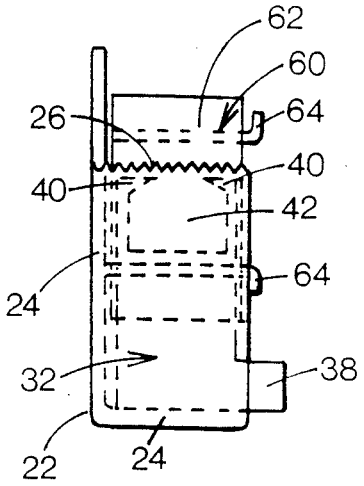
FIG. 2 is a partial front elevation view of FIG. 1.

The first embodiment is shown in FIGS. 1–8. In FIG. 1 the lifting member 32 is shown in its down position below the outstretched tape 70. The lifting member 32 is located between the two guide structures 34. Ears 36 are on the edge of the guide structure 34, and the ears 36 are bent over approximately 90 degrees to enclose the lifting member 32 in the guide structure 34. FIG. 2 shows the protruding foot 38 that is used to raise and lower the lifting member 32. The roll of tape 60 is held on the support shaft 62 and is retained by the support shaft ears 64 being bent over approximately 90 degrees.

Figure 5:
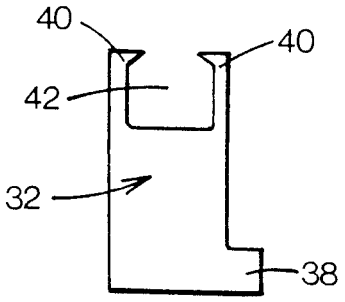
FIG. 5 illustrates the lifting member with two projections and an opening between them.
Figure 6:
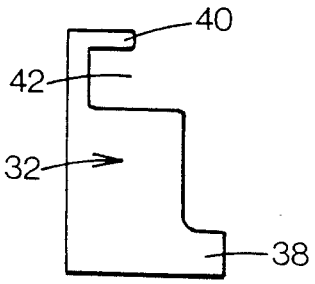
FIG. 6 illustrates the lifting member with one projection and an opening.

FIGS. 5 and 6 show the lifting member 32 in more detail. The embodiment shown in FIG. 6 includes one lifting member tab-forming projection 40 and the opening 42 in the lifting member 32. The embodiment shown in FIG. 5 includes two lifting member tab-forming projections 40 and the opening 42.

Figure 3:
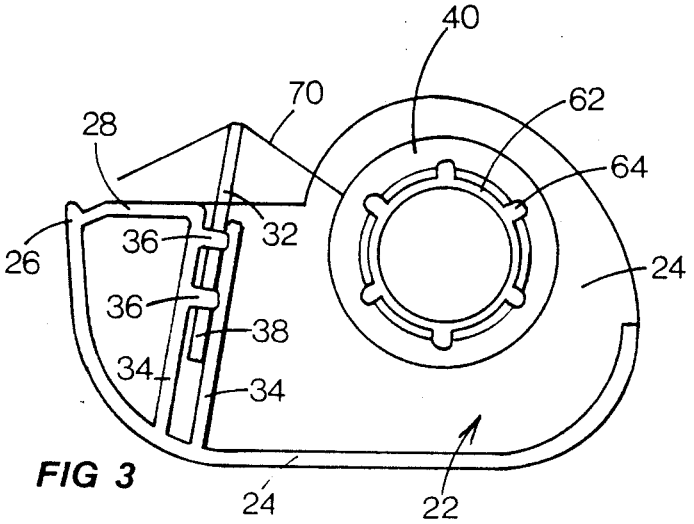
FIG. 3 is a side view similar to FIG. 1 but with the lifting member in its raised position.
Figure 4:
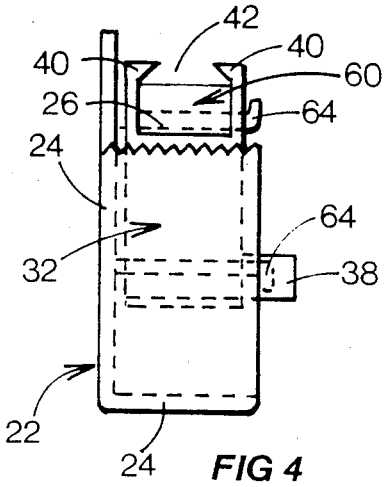
FIG. 4 is a partial front elevation view of FIG. 3.

FIGS. 3, 4, 7, and 8 show the lifting member 32 in the raised position. FIG. 3 shows the outstretched tape 70, which normally extends in a generally horizontal plane from the roll 60 to the cutter edge 26, raised into a hump shape by the raised lifting member 32. FIG. 7 and FIG. 8 show a tab 72, that has been formed by the operator pinching the hump of outstretched tape 70, over the tab-forming projection 40, causing two areas of adhesive to bond to each other in the opening 42.

The tab 72 thus formed can remain bonded over the lifting member tab-forming projection 40 while the tape dispenser 22 is stored until the operator is ready to use it again. By the tab 72 being so fixed, there is no loose length of tape between the tab 72 and the tape roll 60 that will accidentally bond to any undesired object.

The tab 72 can be removed from the lifting member tab-forming projection 40 by the operator sliding the tab 72 off the normally short tapered projection 40. The tab 72 will not bond back to the roll of tape 60 and will be available for the operator to grip and pull the tape from the roll 60 past the cutter edge 26 for the next severing operation.

The second embodiment for forming a non-sticking tab 72 is shown in FIGS. 9–12. The FIGS. 9–12 show the stationary tab-forming structure denoted generally by the numeral 43, with the horizontal projection 44 and the opening 46 under the horizontal projection 44. The tab-forming structure 43 is located above the general horizontal axis of the outstretched tape 70 from the roll 60 to the cutter 26.

Figure 11:
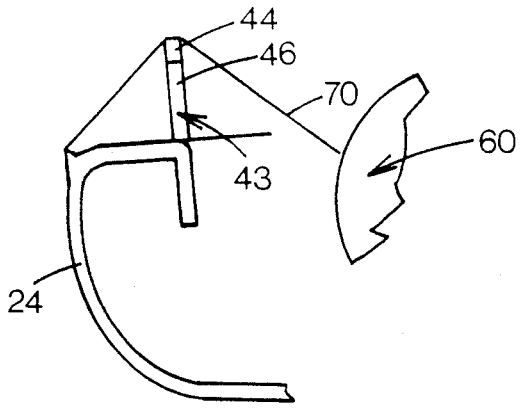
FIG. 11 is a fragmentary side view similar to FIG. 9 showing the outstretched tape draped over the elevated tab-forming structure.
Figure 12:
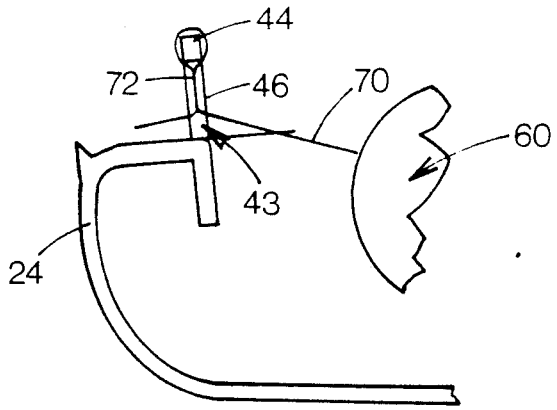
FIG. 12 is a fragmentary side view similar to FIG. 11 with the formed tab.

FIG. 9 shows the outstretched tape 70 being pulled from the roll 60 and severed on the cutter 26 as done in normal usage. After the operator has severed the last desired length of tape, FIG. 11 shows how the operator has lifted the outstretched tape 70 up at approximately a 45 degree angle, so it will extend above the tab-forming structure 43, and back down toward the cutter edge 26, causing a hump to be formed by the outstretched tape 70, over the tab-forming structure 43. FIG. 12 shows a tab 72, that has been formed by the operator pinching the hump of outstretched tape 70, over the horizontal projection 44, causing two areas of adhesive to bond to each other in the opening 46.

The tab 72 can remain fixed to the horizontal projection 44 while the tape dispenser 22 is stored until the next use, or the tab 72 can be removed by sliding it sideways off the normally short tapered horizontal projection 44. The tab will not bond back to the roll 60.

The third embodiment for forming a non-sticking tab 72 is shown in FIGS. 13–15. The FIGS. 13–15 show the stationary tab-forming structure 43 with the horizontal projection 44 and the opening 46 under the horizontal projection 44. The tab-forming structure is located below the general horizontal axis of the outstretched tape 70 from the roll 60 to the cutter 26.

FIG. 13 shows the outstretched tape 70 being pulled from the roll 70 and severed on the cutter 26 as done in normal usage. After the operator has severed the last desired length of tape, FIG. 15 shows how the operator has pressed the outstretched length of tape 70 down and over the horizontal projection 44, and pinched two areas of adhesive together in the opening 46 under the horizontal projection 44, forming a tab 72.

The tab 72 can remain fixed to the horizontal projection 44 while the tape dispenser 22 is stored until the next use, or the tab 72 can be removed by sliding it sideways off the normally short tapered horizontal projection 44. The tab will not bond back to the roll 60.

It will be obvious to those skilled in the art that many variations may be made in the embodiments chosen for the purpose of illustrating the best mode of making and using the present invention without departing from the scope thereof as defined in the appended claims.

What is claimed is:

1. An apparatus for forming a tab on the end portion of outstretched tape on a tape dispenser, comprising:

(a) a base;

(b) a support holder on said base adapted to hold a roll of adhesive type tape;

(c) a cutter edge on said base;

(d) said cutter edge so located that outstretched tape from said roll will pass over the said cutter with the adhesive side of said tape facing down and in contact with said cutter;

(e) a raisable lifting member mounted on said base, located between said roll and said cutter edge and under said outstretched tape;

(f) ribs attached to said base so that said lifting member is guided in a direction generally perpendicular to said outstretched tape;

(g) said lifting member composed of two portions so when said lifting member is raised the first portion of said member is in contact with the said outstretched tape and the second portion of said member creates an opening under the said tape;

(h) said lifting member when raised lifts the outstretched tape so the operator can force the said tape downwardly and rearwardly under the said first portion of said lifting member in contact with said tape to cause two areas of said adhesive surface of said tape to be pinched together in the said opening created by said second portion of said lifting member creating said tab, and so that said tab can be removed by twisting it out of contact with said first portion of said lifting member sand removed from said opening.

* * * * *